US011721316B2

(12) United States Patent
Chen et al.

(10) Patent No.: US 11,721,316 B2
(45) Date of Patent: Aug. 8, 2023

(54) LOW-DELAY HYBRID NOISE REDUCTION SYSTEM

(71) Applicant: SteadyBeat Technology Corp., Hsinchu (TW)

(72) Inventors: Hao Ming Chen, Hsinchu (TW); Ju Chieh Liu, Hsinchu (TW)

(73) Assignee: STEADYBEAT TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 17/723,164

(22) Filed: Apr. 18, 2022

(65) Prior Publication Data

US 2023/0178064 A1 Jun. 8, 2023

(30) Foreign Application Priority Data

Dec. 7, 2021 (TW) ..... 110145646

(51) Int. Cl.
*G10K 11/178* (2006.01)

(52) U.S. Cl.
CPC .. *G10K 11/17879* (2018.01); *G10K 11/17854* (2018.01); *G10K 2210/3026* (2013.01); *G10K 2210/3027* (2013.01); *G10K 2210/3028* (2013.01)

(58) Field of Classification Search
CPC ..... G10K 11/17879; G10K 11/17854; G10K 11/1785; G10K 11/17853; G10K 2210/3026; G10K 2210/3027; G10K 2210/3028
See application file for complete search history.

(56) References Cited

U.S. PATENT DOCUMENTS

2010/0272279 A1* 10/2010 Joho ..... G10K 11/17854 381/71.8

* cited by examiner

*Primary Examiner* — Kile O Blair
(74) *Attorney, Agent, or Firm* — Muncy, Geissler, Olds & Lowe, P.C.

(57) ABSTRACT

A low-delay hybrid noise reduction system includes a reference audio receiving device, an error audio receiving device, an audio output device, and an audio processing device. The audio processing device includes a feedforward noise reduction filter module, a feedback noise reduction filter module, and a mixer. The feedforward noise reduction filter module includes a feedforward least mean squares (LMS) filter, a low-stage finite impulse response (FIR) filter, and 1st to Nth-stage biquad filters. The 1st to Nth-stage biquad filters is set on the input end of the low-stage finite impulse response filter to perform low-delay filtering on the reference source audio signal received and outputs to the low-stage FIR filter so as to output the feedforward noise reduction signal through the low-stage FIR filter.

10 Claims, 4 Drawing Sheets

LOW-DELAY HYBRID NOISE REDUCTION SYSTEM

BACKGROUND OF THE INVENTION

Technical Field

The present invention relates to a low-delay hybrid noise reduction system and more particularly to a low-delay hybrid noise reduction system that features both low delay and high performance.

Description of Related Art

Conventional hybrid active noise control (ANC) systems are such that when group delay takes place, the effect of the group delay is in direct proportion to the stage of the finite impulse response (FIR) filter used in the system; that is to say, the noise cancelation property and performance of the system will be affected if a relatively high-stage FIR filter is used.

One solution is to change the feedforward (FF) noise reduction circuit into an infinite impulse response (IIR) filter such that by sacrificing self-adaptivity to some degree, delay can be reduced, and performance increased. Considering the stability of an IIR filter, however, it will be difficult to carry out adaptive coefficient modification if an IIR filter is used. Therefore, even though the use of an IIR filter can help enhance performance in the first place, the resulting low self-adaptivity will hinder further improvement in performance.

BRIEF SUMMARY OF THE INVENTION

An aspect of the present invention is to provide a low-delay hybrid noise reduction system, comprising a reference audio receiving device, an error audio receiving device, an audio output device, and an audio processing device. The reference audio receiving device receives reference source audio and outputs a reference source audio signal according to the reference source audio. The error audio receiving device receives a error source audio and outputs an error source audio signal according to the error source audio. The audio output device outputs a sound according to an audio signal received. The audio processing device is connected to the reference audio receiving device, the error audio receiving device, and the audio output device. The audio processing device comprises a feedforward noise reduction filter module, a feedback noise reduction filter module, and a mixer. The feedforward noise reduction filter module produces a feedforward noise reduction signal by performing feedforward noise reduction on the reference source audio signal received from the reference audio receiving device, the feedback noise reduction filter module produces a feedback noise reduction signal by performing feedback noise reduction on the error source audio signal received from the error audio receiving device, and the feedforward noise reduction signal and the feedback noise reduction signal are transmitted to the mixer, in order for the mixer to produce a noise reduction signal by mixing the feedforward noise reduction signal and the feedback noise reduction signal and output the noise reduction signal to the audio output device. And the feedforward noise reduction filter module comprises a feedforward least mean squares (LMS) filter, a low-stage finite impulse response (FIR) filter, and 1st to Nth-stage biquad filters, the feedforward LMS filter updates a weight coefficient of the low-stage FIR filter according to the reference source audio signal received and the error source audio signal received, the biquad filters perform low-delay filtering on the reference source audio signal received and output a filtered reference source audio signal to the low-stage FIR filter, and the low-stage FIR filter produces the feedforward noise reduction signal by performing self-adaptive modulation on the filtered reference source audio signal according to the updated weight coefficient and outputs the feedforward noise reduction signal.

Compared with conventional hybrid active noise control systems, the present invention not only reduces group delay effectively, but also allows further improvement in its noise reduction property and performance. In addition, the invention provides greater flexibility in dealing with system delay.

DETAILED DESCRIPTION OF THE INVENTION

A detailed description of the technical contents of the present invention is given below with reference to the accompanying drawings.

The present invention can be applied to the noise reduction device or noise reduction controller in a personal listening system such as a wired headset, a smartphone, a wireless earphone, or other audio devices to be worn on the head. The invention can also be applied to a finite soundproofing system covering a certain space, such as an anechoic chamber, an aircraft, a spacecraft, an electrical appliance, or other similar devices or equipment, without limitation.

Each device or module used in the present invention and its function can be implemented by a single chip or by a combination of chips that work in concert with one another, wherein the number of the chip(s) employed does not constitute an essential feature of the invention. The aforesaid chips may be, but are not limited to, processors, central processing units (CPU), microprocessors, digital signal processors (DSP), application-specific integrated circuits (ASIC), programmable logic devices (PLD), or a combination of the above; the invention has no limitation in this regard. In some embodiments of the invention, each device, module, or combination of devices/modules may be composed of a built-in chip, an integrated chip, or a plurality of separate chips of a device (e.g., a mobile device or wearable device), wherein the configuration of the chip(s) may vary without limitation.

One embodiment of the present invention is described below with reference to FIG. 1 and FIG. 2, which are two block diagrams of the low-delay hybrid noise reduction system of the invention.

Figure 1:
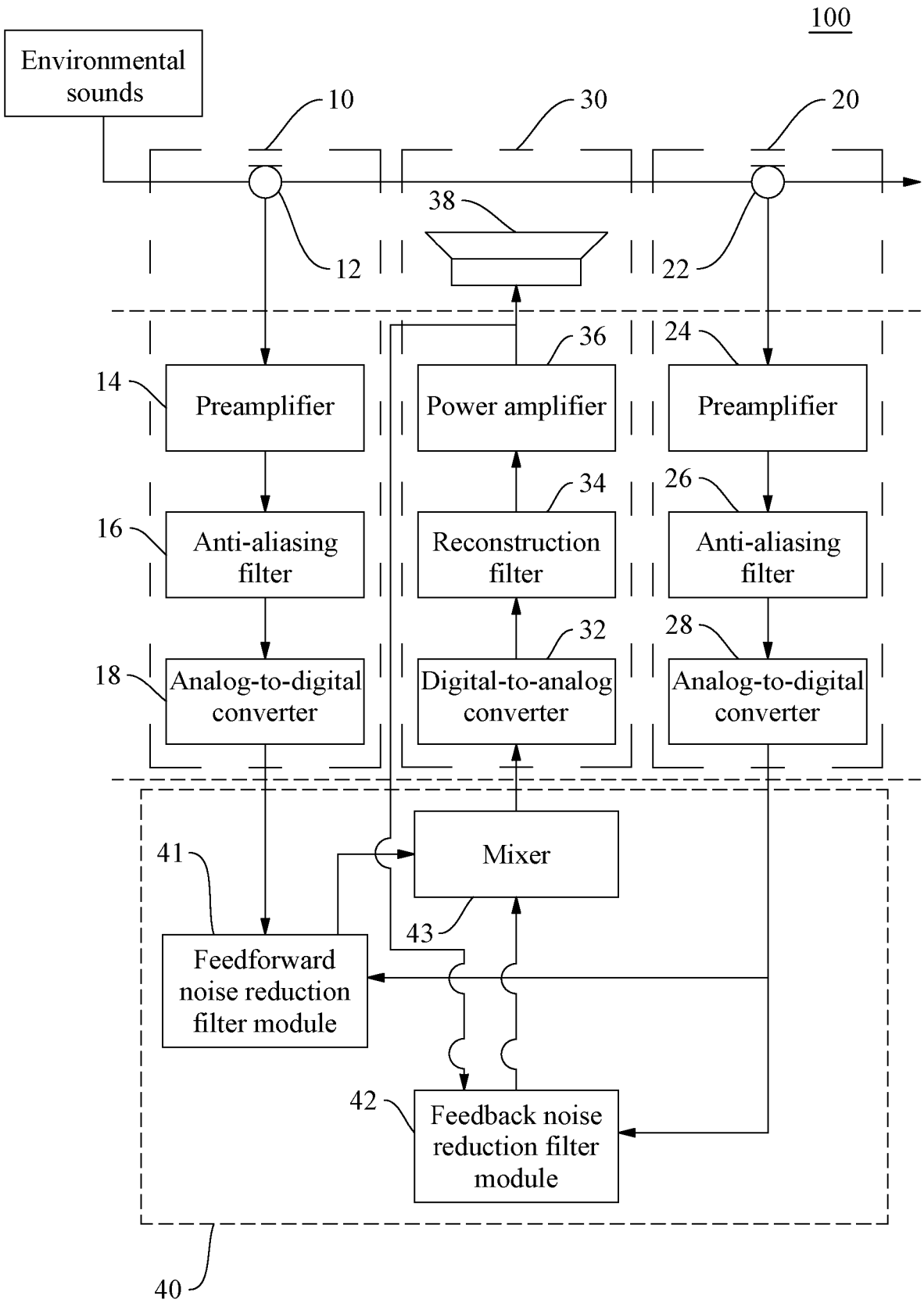
FIG. 1 is a block diagram of the low-delay hybrid noise reduction system of the present invention.
Figure 2:
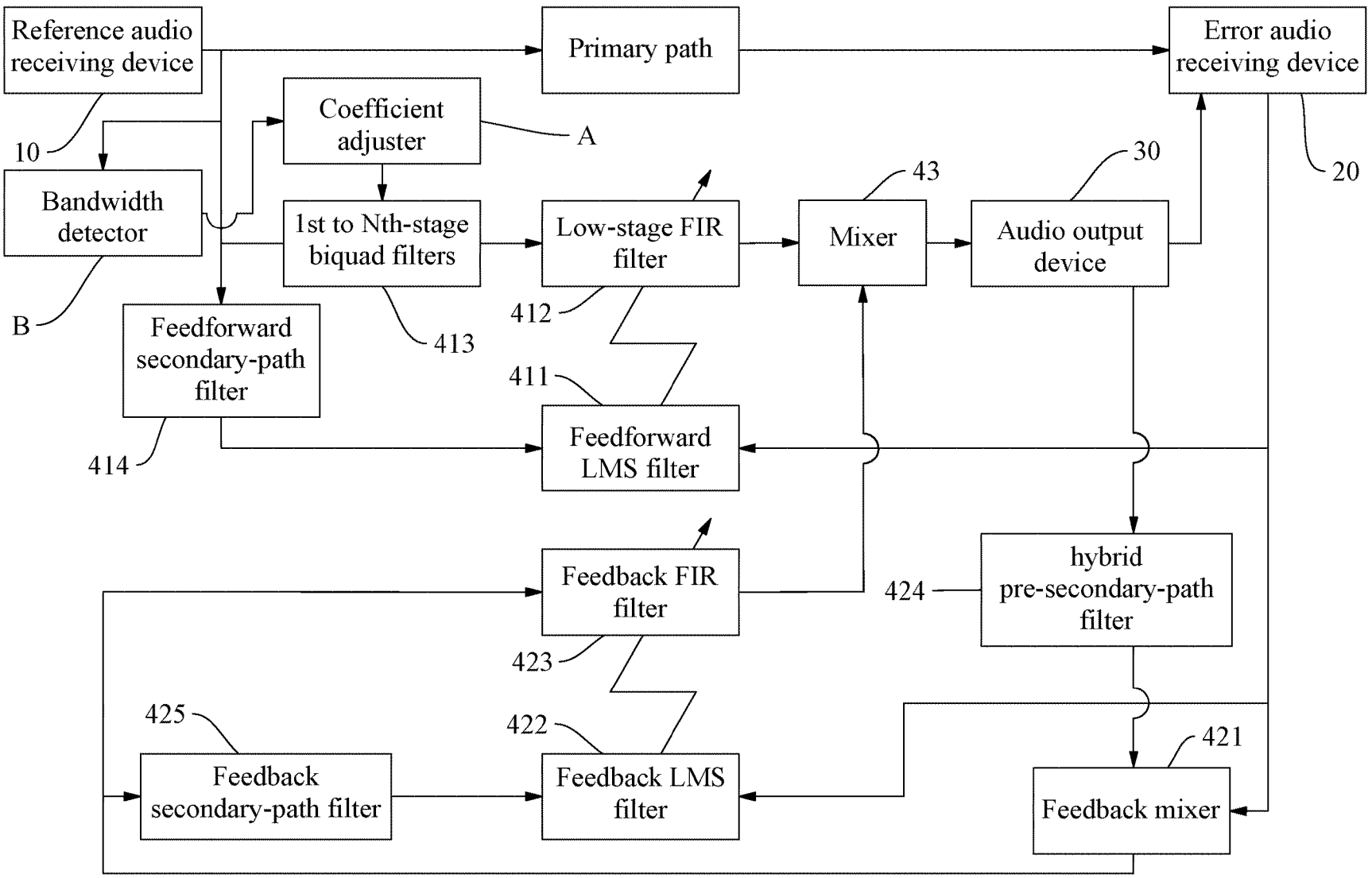
FIG. 2 is another block diagram of the low-delay hybrid noise reduction system of the invention.

As shown in FIG. 1 and FIG. 2, the low-delay hybrid noise reduction system 100 essentially includes a reference audio receiving device 10, an error audio receiving device 20, an audio output device 30, and an audio processing device 40.

The reference audio receiving device 10 serves mainly to receive reference source audio and output a reference source audio signal according to the reference source audio, wherein the reference source audio may be environmental sounds. In one embodiment, the reference audio receiving device 10 may include a microphone (including its audio processing chip), a sound pickup (including its audio processing chip), or a similar device that can receive sound and convert the received sound into an analog or digital audio signal. In one embodiment, the reference audio receiving device 10 includes a reference microphone 12, a preamplifier 14 connected to the output end of the reference microphone 12, an anti-aliasing filter 16 connected to the output end of the preamplifier 14, and an analog-to-digital converter 18 connected to the output end of the anti-aliasing filter 16, wherein the analog-to-digital converter 18 outputs the reference source audio signal to the audio processing device 40.

The error audio receiving device 20 serves mainly to receive error source audio and output an error source audio signal according to the error source audio. The error audio receiving device 20 is provided in an area where noise reduction is desired, and is configured to detect the sound in that area. The error audio receiving device 20 can be so located that the error source audio received thereby is equivalent to the difference between the reference source audio and the sound output by a loudspeaker 38. In one embodiment, the error audio receiving device 20 may include a microphone (including its audio processing chip), a sound pickup (including its audio processing chip), or a similar device that can receive sound and convert the received sound into an analog or digital audio signal. In one embodiment, the error audio receiving device 20 includes an error microphone 22, a preamplifier 24 connected to the output end of the error microphone 22, an anti-aliasing filter 26 connected to the output end of the preamplifier 24, and an analog-to-digital converter 28 connected to the output end of the anti-aliasing filter 26, wherein the analog-to-digital converter 28 outputs the error source audio signal to the audio processing device 40.

The audio output device 30 outputs a sound according to the audio signal received. In one embodiment, the audio output device 30 may include a loudspeaker (including its audio processing chip) or a similar device for outputting sound. In one embodiment, the audio output device 30 includes the following elements sequentially arranged in the foregoing order: the aforesaid loudspeaker 38, a power amplifier 36 connected to the input end of the loudspeaker 38, a reconstruction filter 34 connected to the input end of the power amplifier 36, and a digital-to-analog converter 32 connected to the input end of the reconstruction filter 34, wherein the digital-to-analog converter 32 is connected to the audio processing device 40 in order to convert the digital signal output by the audio processing device 40 into an analog signal able to be output by the loudspeaker 38.

The audio processing device 40 is connected to the reference audio receiving device 10, the error audio receiving device 20, and the audio output device 30 and is configured to process the reference source audio signal received from the reference audio receiving device 10 and the error source audio signal received from the error audio receiving device 20 and output a signal to the audio output device 30 accordingly, in order for the audio output device 30 to output a sound for noise reduction. The audio processing device 40 includes a feedforward noise reduction filter module 41, a feedback noise reduction filter module 42, and a mixer 43.

The feedforward noise reduction filter module 41 performs feedforward noise reduction on the reference source audio signal received from the reference audio receiving device 10 so as to produce a feedforward noise reduction signal. More specifically, the feedforward noise reduction filter module 41 performs self-adaptive computation on the received reference source audio signal in order to produce a signal that can reduce noise by canceling the noise in environmental sounds. As shown in FIG. 2, the feedforward noise reduction filter module 41 includes a feedforward least mean squares (LMS) filter 411, a low-stage finite impulse response (FIR) filter 412, and the 1st to the Nth-stage biquad filters 413. The feedforward LMS filter 411 updates the weight coefficient of the low-stage FIR filter 412 according to the reference source audio signal and error source audio signal received. The 1st to the Nth-stage biquad filters 413 perform low-delay filtering on the reference source audio signal received and output the filtered reference source audio signal to the low-stage FIR filter 412. The low-stage FIR filter 412 performs self-adaptive modulation on the filtered reference source audio signal according to the updated weight coefficient and outputs the feedforward noise reduction signal. In one embodiment, the low-stage FIR filter 412 may be of stage 8 or stage 16; the present invention has no limitation in this regard.

In this embodiment, provided between the reference audio receiving device 10 and the feedforward LMS filter 411 is a feedforward secondary-path filter 414 for filtering the reference source audio signal in advance. The feedforward secondary-path filter 414 is configured to estimate the transfer function in the actual path so that, after the feedforward LMS filter 411 adjusts the weight coefficient of the low-stage FIR filter 412, the low-stage FIR filter 412 can produce, and send to the mixer 43 a noise reduction signal that has the same magnitude as, and the opposite phase to, the noise in environmental sounds.

The feedback noise reduction filter module 42 performs feedback noise reduction on the error source audio signal received from the error audio receiving device 20 so as to produce a feedback noise reduction signal. More specifically, the feedback noise reduction filter module 42 performs self-adaptive computation on the received error source audio signal in order to produce a signal that can reduce noise by canceling the high-frequency noise in environmental sounds. The signal output by the feedback noise reduction filter module 42 to cancel the high-frequency noise in environmental sounds is defined herein as a high-frequency noise reduction signal. As shown in FIG. 2, the feedback noise reduction filter module 42 includes a feedback mixer 421, a feedback LMS filter 422, and a feedback FIR filter 423. The feedback mixer 421 mixes an audio signal with the error source audio signal and outputs a mixed signal. The audio signal received by the feedback mixer 421 is obtained through the feedback signal input to the speaker 38. The feedback LMS filter 422 updates the weight coefficient of the feedback FIR filter 423 according to the mixed signal and error source audio signal received.

In one embodiment, a hybrid pre-secondary-path filter 424 is provided in the path through which the source audio signal input into the loudspeaker 38 is fed back to the feedback mixer 421, in order to filter the feedback signal input from the loudspeaker 38. In one embodiment, a feedback secondary-path filter 425 is provided between the feedback mixer 421 and the feedback LMS filter 422 in order to filter the feedback mixed signal to be input into the feedback LMS filter 422. The hybrid pre-secondary-path filter 424 and the feedback secondary-path filter 425 serve to estimate the transfer function in the actual path in order for the feedback LMS filter 422 to update the weight coefficient of the feedback FIR filter 423 according to the feedback mixed signal and error source audio signal received, and for the feedback FIR filter 423 to perform noise reduction on the feedback mixed signal according to the updated weight coefficient and output the feedback noise reduction signal to the mixer 43.

The mixer 43 is configured to mix the feedforward noise reduction signal and the feedback noise reduction signal and output the noise reduction signal, which is a mixture of the feedforward noise reduction signal and the feedback noise reduction signal, to the audio output device 30.

One embodiment of the 1st to the Nth-stage biquad filters 413 in the feedforward noise reduction filter module 41 is described below. The plural of biquad filters which the 1st to the Nth-stage biquad filters 413 contains are connected in series such that an input end of each but the first biquad filter is connected to the output end of the previous biquad filter (e.g., an input end of the Nth-stage biquad filter is connected to the input end of the N-1th-stage biquad filter). The highest stage of the biquad filters can be designed according to practical needs; the present invention has no limitation in this regard.

Figure 3:
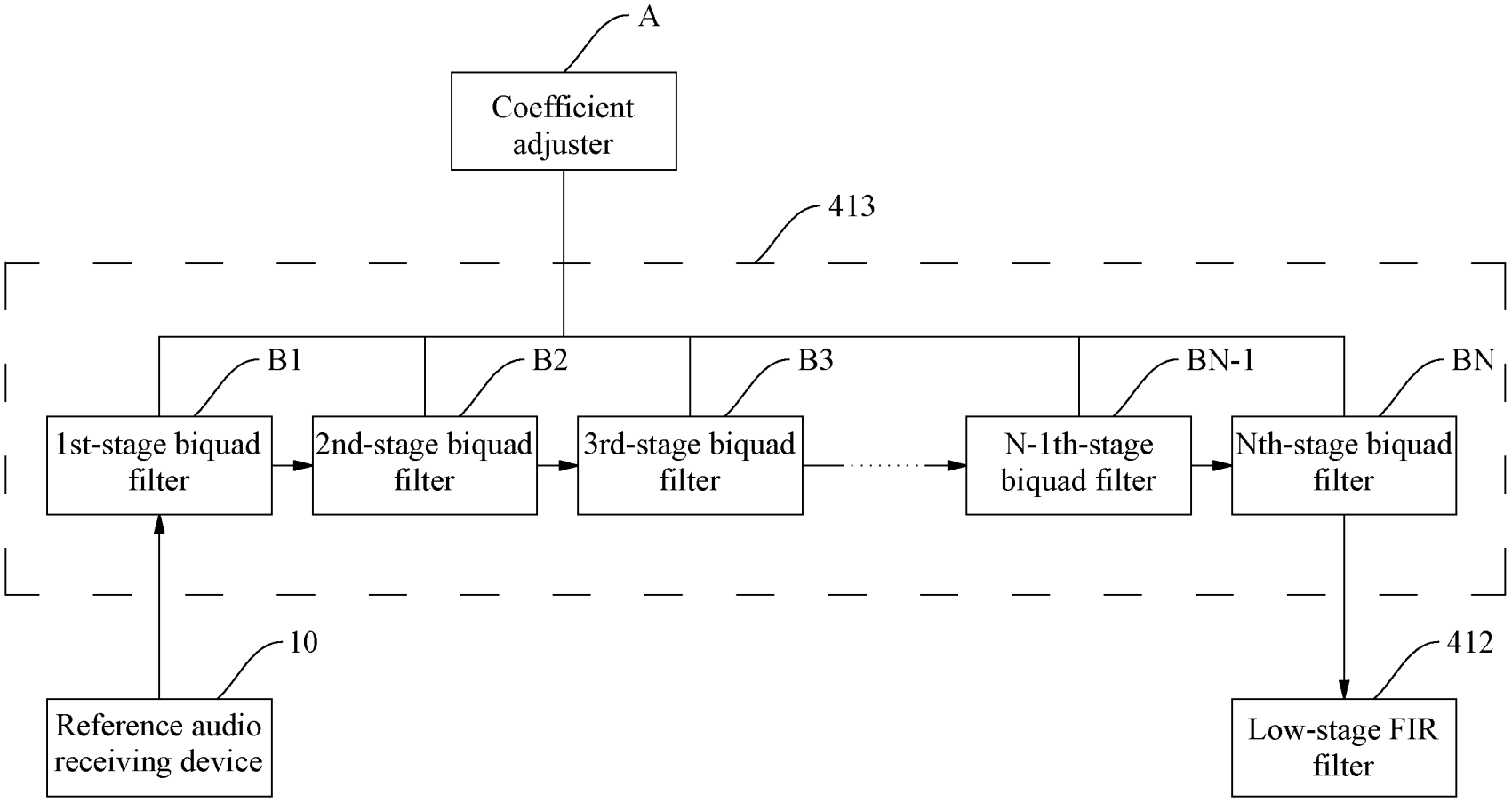
FIG. 3 is a block diagram of the 1st to the Nth-stage biquad filters in the invention.

In one embodiment, the 1st to the Nth-stage biquad filters 413 in the feedforward noise reduction filter module 41 are arranged as follows according to their stages. Please refer to FIG. 3 and FIG. 4 respectively for a block diagram of the 1st to the Nth-stage biquad filters in the present invention and a block diagram of a single biquad filter in the invention. As shown in FIG. 3, the output end of the 1st-stage biquad filter B1 is connected to an input end of the 2nd-stage biquad filter B2 the output end of the 2nd-stage biquad filter B2 is connected to an input end of the 3rd-stage biquad filter B3, so on and so forth, and the output end of the N-1th-stage biquad filter BN-1 is connected to an input end of the Nth-stage biquad filter BN.

Figure 4:
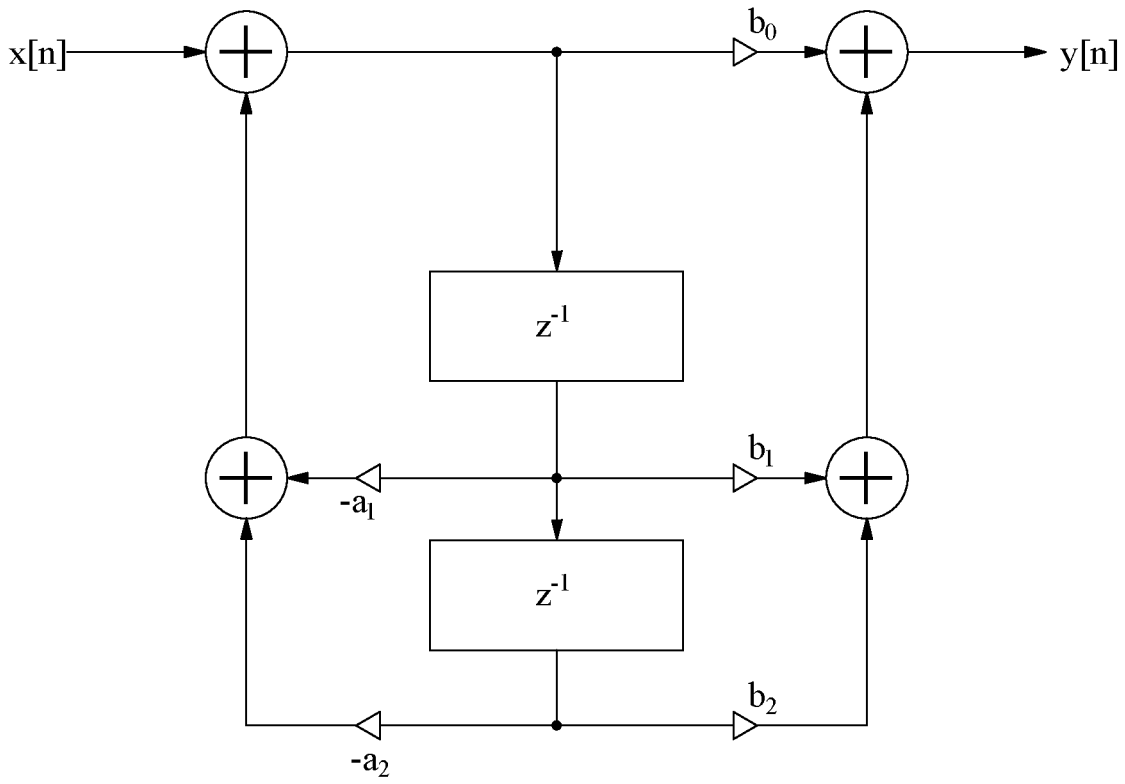
FIG. 4 is a block diagram of a single biquad filter in the invention.

As shown in FIG. 4, each of the 1st to the Nth-stage biquad filters 413 filters the referencesource audio signal according to the following equation:

$$y[n]=b_0\times x[n]+b_1\times x[n-1]+b_2\times x[n-2]-a_1\times y[n-1]-a_2\times y[n-2],$$

Wherein x[n], x[n−1], and x[n−2] are signals input into the biquad filter at the nth, n-1th, and n-2th-stage time points respectively; y[n], y[n−1], and y[n−2] are signals output by the biquad filter at the nth, n-1th, and n-2th-stage time points respectively; and $b_0$, $b_1$, $b_2$, $a_1$, and $a_2$are coefficients of the biquad filter.

In one embodiment, the feedforward noise reduction filter module 41 includes a coefficient adjuster A connected to the 1st to the Nth-stage biquad filters 413 and a bandwidth detector B that is connected to the reference audio receiving device 10 and configured to detect the center frequency of the reference source audio signal and send the detected center frequency to the coefficient adjuster A. More specifically, the bandwidth detector B detects the noise frequency distribution of the reference source audio signal so as to track the state of the reference source audio signal and output to the coefficient adjuster A a noise bandwidth signal having the same bandwidth as the center frequency of the reference source audio signal, and the coefficient adjuster A determines the coefficients of the 1st to the Nth-stage biquad filters 413 according to the sound received by the reference audio receiving device 10. The present invention has no limitation on the configuration of the coefficient adjuster A or of the bandwidth detector B, provided that the bandwidth detector B can output to the coefficient adjuster A a bandwidth signal having the same bandwidth as the center frequency of the reference source audio signal, and that the coefficient adjuster A modifies the coefficients of the 1st to the Nth-stage biquad filters 413 according to the bandwidth signal.

The hardware structure of the present invention has been described above with reference to some embodiments thereof. The following paragraphs further describe the working principles of the invention.

In one embodiment, the coefficients of the 1st to the Nth-stage biquad filters 413 may be so set as to turn those filters into a low-pass filter, in order for the low-stage FIR filter 412 to self-adapt to and be able to filter out low-frequency signals. To that end, the coefficient adjuster A may modify the coefficients of the biquad filter of each stage according to the following equations respectively:

$$b_0=\frac{1-\cos(w_0)}{2\times(1+\alpha)},$$
$$b_1=\frac{1-\cos(w_0)}{(1+\alpha)},$$
$$b_2=\frac{1-\cos(w_0)}{2\times(1+\alpha)},$$
$$a_1=\frac{-2\times\cos(w_0)}{(1+\alpha)},\text{ and}$$
$$a_2=\frac{(1-\alpha)}{(1+\alpha)},$$

wherein $w_0$ is the central angular frequency; αis a natural-frequency parameter; and $b_0$, $b_1$, $b_2$, $a_1$, and $a_2$ are the coefficients of the biquad filter.

In another embodiment, the coefficients of the 1st to the Nth-stage biquad filters 413 may be so set as to turn those filters into a high-pass filter, in order for the low-stage FIR filter 412 to self-adapt to and be able to filter out high-frequency signals. To that end, the coefficient adjuster A may modify the coefficients of the biquad filter of each stage according to the following equations respectively:

$$b_0=\frac{1+\cos(w_0)}{2\times(1+\alpha)},$$
$$b_1=\frac{1+\cos(w_0)}{(1+\alpha)},$$
$$b_2=\frac{1+\cos(w_0)}{2\times(1+\alpha)},$$
$$a_1=\frac{-2\times\cos(w_0)}{(1+\alpha)},\text{ and}$$
$$a_2=\frac{(1-\alpha)}{(1+\alpha)},$$

wherein $w_0$ is the central angular frequency; αis a natural-frequency parameter; and $b_0$, $b_1$, $b_2$, $a_1$, and $a_2$ are the coefficients of the biquad filter.

In another embodiment, the coefficients of the 1st to the Nth-stage biquad filters 413 may depending on practical needs, be so set as to turn those filters into a peak equalizing filter. To that end, the coefficient adjuster A may modify the coefficients of the biquad filter of each stage according to the following equations respectively:

$$b_0 = \frac{1+\alpha A}{1+\frac{\alpha}{A}},$$

$$b_1 = \frac{-2\times\cos(w_0)}{1+\frac{\alpha}{A}},$$

$$b_2 = \frac{1-\alpha A}{1+\frac{\alpha}{A}},$$

$$a_1 = \frac{-2\times\cos(w_0)}{1+\frac{\alpha}{A}}, \text{ and}$$

$$a_2 = \frac{1-\frac{\alpha}{A}}{1+\frac{\alpha}{A}},$$

wherein $w_0$ is the central angular frequency; $\alpha$is a natural-frequency parameter; $b_0$, $b_1$, $b_2$, $a_1$, and $a_2$ are the coefficients of the biquad filter; and A is an amplitude scaling coefficient.

In one embodiment, the central angular frequency and the natural-frequency parameter are obtained through the following equations respectively:

$$w_0 = 2\times\pi\times\frac{f_k}{F_s}, \text{ and}$$

$$\alpha = \frac{\sin w_0}{2\times Q},$$

wherein $f_k$ is the center frequency obtained by the bandwidth detector B, $F_s$ is the frequency of the input of the reference audio receiving device 10, Q is a preset quality parameter, $w_0$ is the central angular frequency, and $\alpha$is the natural-frequency parameter.

In one embodiment, the center frequency is derived from the reference source audio signal by the bandwidth detector B according to the following equations:

$$f_k = \sum_{n=0}^{M-1} x[n]\times e^{-i2\pi k\frac{n}{M}}, \text{ and}$$

$$k = 0, \ldots, M-1,$$

wherein x[n] is the reference source audio signal input by the reference audio receiving device 10 in the nth stage, $f_k$ is the center frequency output by the bandwidth detector B, $f_k$ has M outputs, and M is a preset output number.

In view of the above, the present invention compared with conventional hybrid active noise control systems can not only reduces group delay effectively, but also allows further improvement in its noise reduction property and performance. In addition, the invention provides greater flexibility in dealing with system delay.

The above is the detailed description of the present invention. However, the above is merely the preferred embodiment of the present invention and cannot be the limitation to the implement scope of the invention, which means the variation and modification according to the present invention may still fall into the scope of the present invention.

What is claimed is:

1. A low-delay hybrid noise reduction system, comprising:

a reference audio receiving device for receiving reference source audio and outputting a reference source audio signal according to the reference source audio;

an error audio receiving device for receiving error source audio and outputting an error source audio signal according to the error source audio;

an audio output device for outputting a sound according to an audio signal received; and an audio processing device connected to the reference audio receiving device, the error audio receiving device, and the audio output device, wherein the audio processing device comprises a feedforward noise reduction filter module, a feedback noise reduction filter module, and a mixer, the feedforward noise reduction filter module produces a feedforward noise reduction signal by performing feedforward noise reduction on the reference source audio signal received from the reference audio receiving device, the feedback noise reduction filter module produces a feedback noise reduction signal by performing feedback noise reduction on the error source audio signal received from the error audio receiving device, and the feedforward noise reduction signal and the feedback noise reduction signal are transmitted to the mixer, in order for the mixer to produce a noise reduction signal by mixing the feedforward noise reduction signal and the feedback noise reduction signal and output the noise reduction signal to the audio output device;

wherein the feedforward noise reduction filter module comprises a feedforward least mean squares (LMS) filter, a low-stage finite impulse response (FIR) filter, and $1^{st}$ to $N^{th}$-stage biquad filters, the feedforward LMS filter updates a weight coefficient of the low-stage FIR filter according to the reference source audio signal received and the error source audio signal received, the $1^{st}$ to the $N^{th}$-stage biquad filters perform low-delay filtering on the reference source audio signal received and output a filtered reference source audio signal to the low-stage FIR filter, and the low-stage FIR filter produces the feedforward noise reduction signal by performing self-adaptive modulation on the filtered reference source audio signal according to the updated weight coefficient and outputs the feedforward noise reduction signal.

2. The low-delay hybrid noise reduction system of claim 1, wherein the low-stage FIR filter is of stage 8 or stage 16.

3. The low-delay hybrid noise reduction system of claim 2, wherein the plural of biquad filters which the $1^{st}$ to the $N^{th}$-stage biquad filters contain are connected in series, and each said biquad filter filters the reference source audio signal according to the following equation:

$$y[n]=b_0\times x[n]+b_1\times x[n-1]+b_2\times x[n-2]-a_1\times y[n-1]-a_2\times y[n-2];$$

wherein x[n], x[n−1], and x[n−2] are signals input into the each said biquad filter at $n^{th}$, n-$1^{th}$, and n-$2^{th}$-stage time points respectively; y[n], y[n−1], and y[n−2] are signals output by the each said biquad filter at the $n^{th}$, n-$1^{th}$, and n-$2^{th}$-stage time points respectively; and $b_0$, $b_1$, $b_2$, $a_1$, and $a_2$ are coefficients of the each said biquad filter.

4. The low-delay hybrid noise reduction system of claim 3, wherein the feedforward noise reduction filter module comprises a coefficient adjuster connected to the $1^{st}$ to the $N^{th}$-stage biquad filters and a bandwidth detector connected to the reference audio receiving device and configured for detecting a center frequency of the reference source audio signal and transmitting the center frequency to the bandwidth detector of the coefficient adjuster.

5. The low-delay hybrid noise reduction system of claim 4, wherein the coefficient adjuster modifies the coefficients of the biquad filter of each stage according to the following equations:

$$b_0 = \frac{1-\cos(w_0)}{2\times(1+\alpha)},$$
$$b_1 = \frac{1-\cos(w_0)}{(1+\alpha)},$$
$$b_2 = \frac{1-\cos(w_0)}{2\times(1+\alpha)},$$
$$a_1 = \frac{-2\times\cos(w_0)}{(1+\alpha)}, \text{ and}$$
$$a_2 = \frac{(1-\alpha)}{(1+\alpha)},$$

wherein $w_0$ is a central angular frequency; $\alpha$is a natural-frequency parameter; and $b_0$, $b_1$, $b_2$, $a_1$, and $a_2$ are the coefficients of the biquad filter.

6. The low-delay hybrid noise reduction system of claim 4, wherein the coefficient adjuster modifies the coefficients of the biquad filter of each stage according to the following equations:

$$b_0 = \frac{1+\cos(w_0)}{2\times(1+\alpha)},$$
$$b_1 = \frac{1+\cos(w_0)}{(1+\alpha)},$$
$$b_2 = \frac{1+\cos(w_0)}{2\times(1+\alpha)},$$
$$a_1 = \frac{-2\times\cos(w_0)}{(1+\alpha)}, \text{ and}$$
$$a_2 = \frac{(1-\alpha)}{(1+\alpha)},$$

wherein $w_0$ is a central angular frequency; $\alpha$is a natural-frequency parameter; and $b_0$, $b_1$, $b_2$, $a_1$, and $a_2$ are the coefficients of the biquad filter.

7. The low-delay hybrid noise reduction system of claim 4, wherein the coefficient adjuster modifies the coefficients of the biquad filter of each stage according to the following equations:

$$b_0 = \frac{1+\alpha A}{1+\frac{\alpha}{A}},$$
$$b_1 = \frac{-2\times\cos(w_0)}{1+\frac{\alpha}{A}},$$
$$b_2 = \frac{1-\alpha A}{1+\frac{\alpha}{A}},$$

-continued $$a_1 = \frac{-2\times\cos(w_0)}{1+\frac{\alpha}{A}}, \text{ and}$$
$$a_2 = \frac{1-\frac{\alpha}{A}}{1+\frac{\alpha}{A}},$$

wherein $w_0$ is a central angular frequency; $\alpha$is a natural-frequency parameter; $b_0$, $b_1$, $b_2$, $a_1$, and $a_2$ are the coefficients of the biquad filter; and A is an amplitude scaling coefficient.

8. The low-delay hybrid noise reduction system of any of claims 5 to 7, wherein the central angular frequency and the natural-frequency parameter are obtained through the following equations respectively:

$$w_0 = 2\times\pi\times\frac{f_k}{F_s}, \text{ and}$$
$$\alpha = \frac{\sin w_0}{2\times Q},$$

wherein $f_k$ is the center frequency obtained by the bandwidth detector, $F_s$ is a frequency input by the reference audio receiving device, Q is a preset quality parameter, $w_0$ is the central angular frequency, and $\alpha$is the natural-frequency parameter.

9. The low-delay hybrid noise reduction system of claim 8, wherein the center frequency is derived from the reference source audio signal by the bandwidth detector according to the following equations:

$$f_k = \sum_{n=0}^{M-1} x[n]\times e^{-i2\pi k\frac{n}{M}}, \text{ and}$$
$$k = 0, \ldots, M-1,$$

wherein x[n] is a said reference source audio signal input by the reference audio receiving device in an $n^{th}$ stage, $f_k$ is the center frequency output by the bandwidth detector, $f_K$ has M outputs, and M is a preset number.

10. The low-delay hybrid noise reduction system of claim 9, wherein the feedback noise reduction filter module comprises a feedback mixer, a feedback LMS filter, and a feedback FIR filter, the feedback mixer mixes the noise reduction signal with the error source audio signal and outputs a mixed signal, the feedback LMS filter updates a weight coefficient of the feedback FIR filter according to the mixed signal received and the error source audio signal received, and the feedback FIR filter produces the feedback noise reduction signal by performing self-adaptive modulation on the mixed signal according to the updated weight coefficient of the feedback FIR filter and outputs the feedback noise reduction signal.

* * * * *